US010393352B2

(12) United States Patent
Lee et al.

(10) Patent No.: US 10,393,352 B2
(45) Date of Patent: Aug. 27, 2019

(54) ELASTOMERIC RETENTION RING FOR LAMPS

(71) Applicant: The Toro Company, Bloomington, MN (US)

(72) Inventors: Hyok Lee, Riverside, CA (US); Peter Nanninga, Eastvale, CA (US); Greg Shaw, Moreno Valley, CA (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 15/729,538

(22) Filed: Oct. 10, 2017

(65) Prior Publication Data

US 2018/0100638 A1 Apr. 12, 2018

Related U.S. Application Data

(60) Provisional application No. 62/405,417, filed on Oct. 7, 2016.

(51) Int. Cl.

| | |
|---|---|
| ***F21V 17/10*** | (2006.01) |
| ***F21V 19/00*** | (2006.01) |
| ***F21V 21/30*** | (2006.01) |
| ***F21W 131/10*** | (2006.01) |
| ***F21Y 101/00*** | (2016.01) |
| ***F21S 8/02*** | (2006.01) |
| ***F21S 8/00*** | (2006.01) |

(52) U.S. Cl.

CPC ..... *F21V 19/007* (2013.01); *F21S 8/022* (2013.01); *F21S 8/032* (2013.01); *F21V 17/104* (2013.01); *F21V 21/30* (2013.01); *F21W 2131/10* (2013.01); *F21Y 2101/00* (2013.01)

(58) Field of Classification Search

CPC ..... F21V 17/104; F21V 19/007; F21V 21/30; F21V 21/04–049; F21S 8/022; F21S 8/032

See application file for complete search history.

(56) References Cited

U.S. PATENT DOCUMENTS

| | | | | |
|---|---|---|---|---|
| 2,144,931 A | | 1/1939 | Poey | |
| 2,252,395 A | | 8/1941 | Cohen | |
| 2,481,531 A | | 9/1949 | Phillips | |
| 2,979,603 A | * | 4/1961 | Falge | F21S 45/10 362/368 |
| 3,065,340 A | * | 11/1962 | Mead | F21S 45/10 362/369 |
| 3,231,731 A | | 1/1966 | McDonald | |
| 3,235,771 A | | 2/1966 | Schwartz | |
| 3,740,541 A | | 6/1973 | Conradt | |
| 4,143,411 A | | 3/1979 | Roberts | |
| 4,161,021 A | | 7/1979 | George, Jr. | |

(Continued)

FOREIGN PATENT DOCUMENTS

| | | | |
|---|---|---|---|
| CN | 102620216 A | * | 8/2012 |
| EP | 0502489 A1 | | 9/1992 |
| FI | 911154 A | | 7/1992 |

*Primary Examiner* — Mariceli Santiago

(74) *Attorney, Agent, or Firm* — Inskeep IP Group, Inc.

(57) ABSTRACT

A lighting assembly is described, having an elastomeric, cylindrical ring with one or more grooves along its inner surface for engaging various components within an outdoor light assembly. For example, the elastomeric ring can engage with a disc-shaped lens, a light bulb, and/or various areas of the housing of the light assembly.

19 Claims, 19 Drawing Sheets

(56) References Cited

U.S. PATENT DOCUMENTS 4,462,066 A 7/1984 Gibson et al.
4,489,367 A * 12/1984 Herron ..... F21V 25/12 362/267
4,724,282 A 2/1988 Toder
4,774,648 A 9/1988 Kakuk et al.
4,841,422 A 6/1989 Groh
4,858,877 A 8/1989 Carter
4,884,178 A 11/1989 Roberts
4,937,499 A 6/1990 Hunte
4,983,307 A 1/1991 Nesathurai
4,984,139 A 1/1991 Goggia
4,996,636 A 2/1991 Lovett
4,998,042 A 3/1991 Schilling, Jr.
5,027,262 A 6/1991 Freed
5,086,379 A 2/1992 Denison et al.
5,113,325 A 5/1992 Eisenbraun
5,149,188 A 9/1992 Robbins
5,156,454 A 10/1992 White
5,165,778 A 11/1992 Matthias et al.
5,222,799 A 6/1993 Sears et al.
5,280,417 A 1/1994 Hall et al.
5,349,508 A 9/1994 Karbaf
5,567,045 A 10/1996 Bucek
5,580,158 A 12/1996 Aubrey et al.
5,601,448 A 2/1997 Poon
5,607,224 A 3/1997 Tobias et al.
5,618,098 A * 4/1997 Naganawa ..... B60Q 1/0483 362/267
5,634,820 A 6/1997 Vakil
5,672,941 A 9/1997 Callahan et al.
5,720,544 A 2/1998 Shu
5,828,183 A 10/1998 Wang et al.
5,839,819 A 11/1998 Pan
5,886,423 A 3/1999 Gershen et al.
5,893,634 A 4/1999 Wang
5,917,288 A 6/1999 Feldman et al.
5,962,982 A 10/1999 Mancuso
6,157,139 A 12/2000 Gibboney, Jr.
6,160,353 A 12/2000 Mancuso
6,218,787 B1 4/2001 Murcko et al.
6,386,729 B1 5/2002 Bober
6,488,388 B2 12/2002 Jones
6,502,967 B2 1/2003 Mullen
6,710,588 B1 3/2004 Verfuerth et al.
6,755,557 B2 6/2004 Stauner et al.
6,808,301 B2 * 10/2004 Byggmaster ..... F21S 45/10 362/546
6,812,970 B1 11/2004 McBride
7,918,591 B2 4/2011 Lynch
8,136,958 B2 3/2012 Verfuerth et al.
2002/0166125 A1 11/2002 Fulmer, II
2003/0156367 A1 8/2003 Macbeth
2003/0179577 A1 9/2003 Marsh
2004/0252492 A1 12/2004 Peterson
2006/0270250 A1 11/2006 Allen
2007/0127234 A1 6/2007 Jervey, III
2011/0062888 A1 3/2011 Bondy et al.
2013/0083538 A1 * 4/2013 Totani ..... F21V 1/22 362/277
2013/0286644 A1 10/2013 Lai
2015/0055363 A1 * 2/2015 Van Straten ..... F21S 8/085 362/520

* cited by examiner

ELASTOMERIC RETENTION RING FOR LAMPS

RELATED APPLICATIONS

This application claims priority to U.S. Provisional Application Ser. No. 62/405,417 filed Oct. 7, 2017 entitled Elastomeric Retention Ring for Lamps, which is hereby incorporated herein by reference in its entirety.

BACKGROUND OF THE INVENTION

Several different lamps currently sold, such as LED or halogen landscape lights, use springs, metal retainer rings with finger elements, and similar mechanisms to retain various components of the lamp within its housing. For example, these retaining mechanisms may retain the LED or halogen light bulb, the specialty lens, or similar components.

However, these retaining mechanisms can sometimes result in their components becoming misaligned or dislodged. Hence, there is a need for more durable and robust retaining mechanisms for these lights to maintain the components in their intended positions and orientations.

SUMMARY OF THE INVENTION

The embodiments of this specification generally relate to lights and lighting assemblies. More specifically, these embodiments are related to outdoor lighting, which is described further in U.S. Pat. No. 7,699,481, which is hereby incorporated by reference in its entirety.

In one embodiment, the present invention is directed to an elastomeric ring having one or more grooves along its inner surface for engaging various components within an outdoor light assembly. For example, the elastomeric ring can engage with a disc-shaped lens, a light bulb, and/or various areas of the housing of the light assembly.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
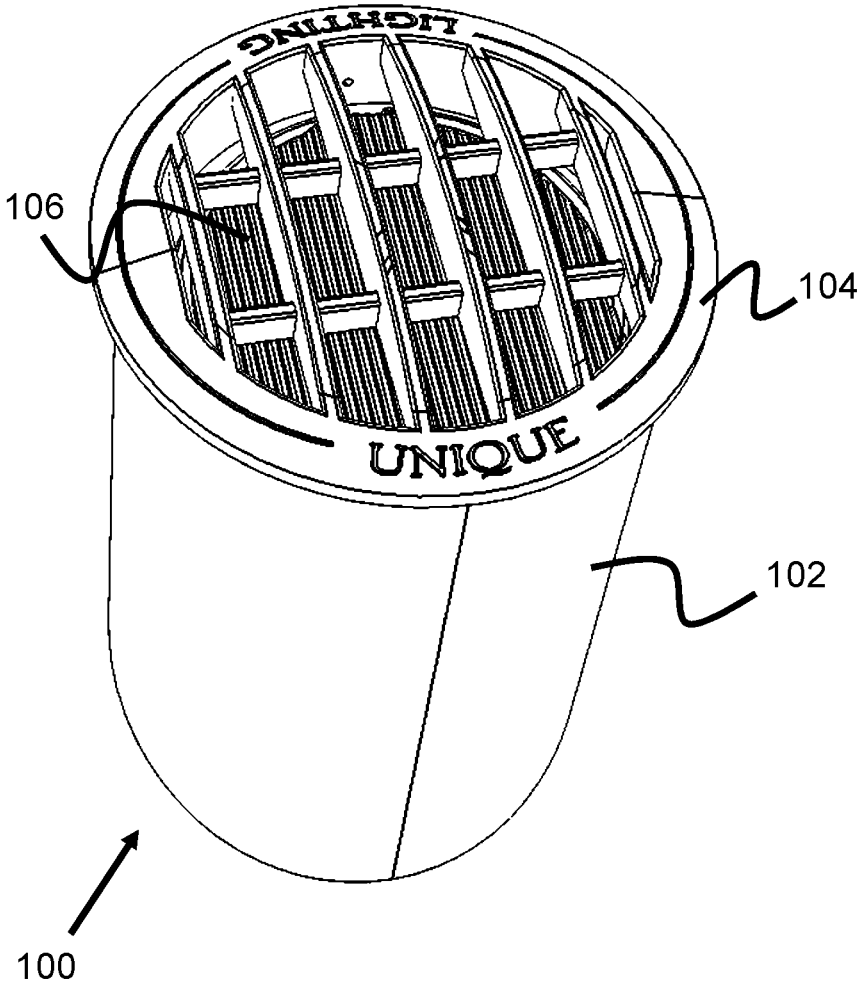
FIGS. 1-10 illustrate various views of one embodiment of a light assembly having an elastomeric ring.
Figure 2:
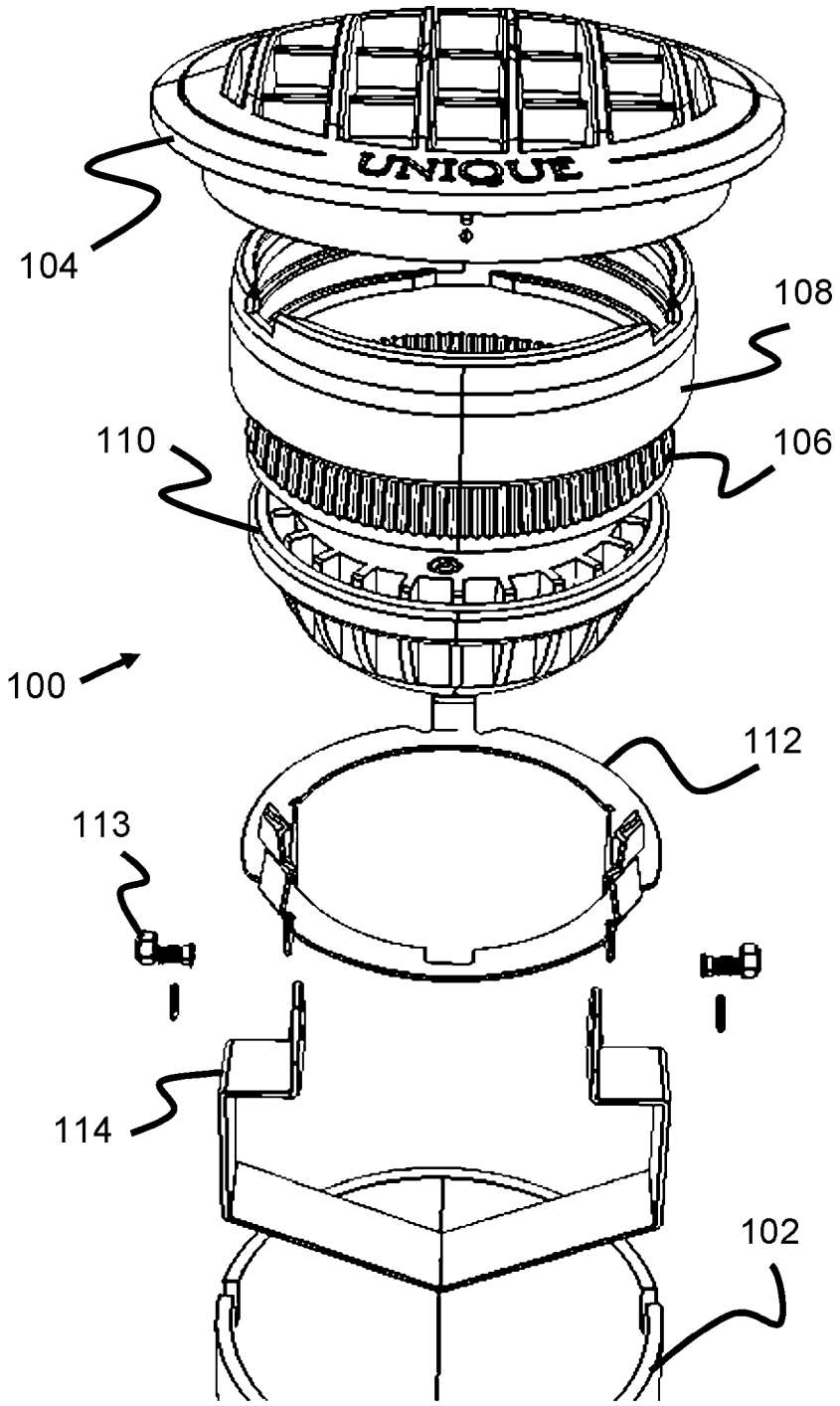
Figure 3:
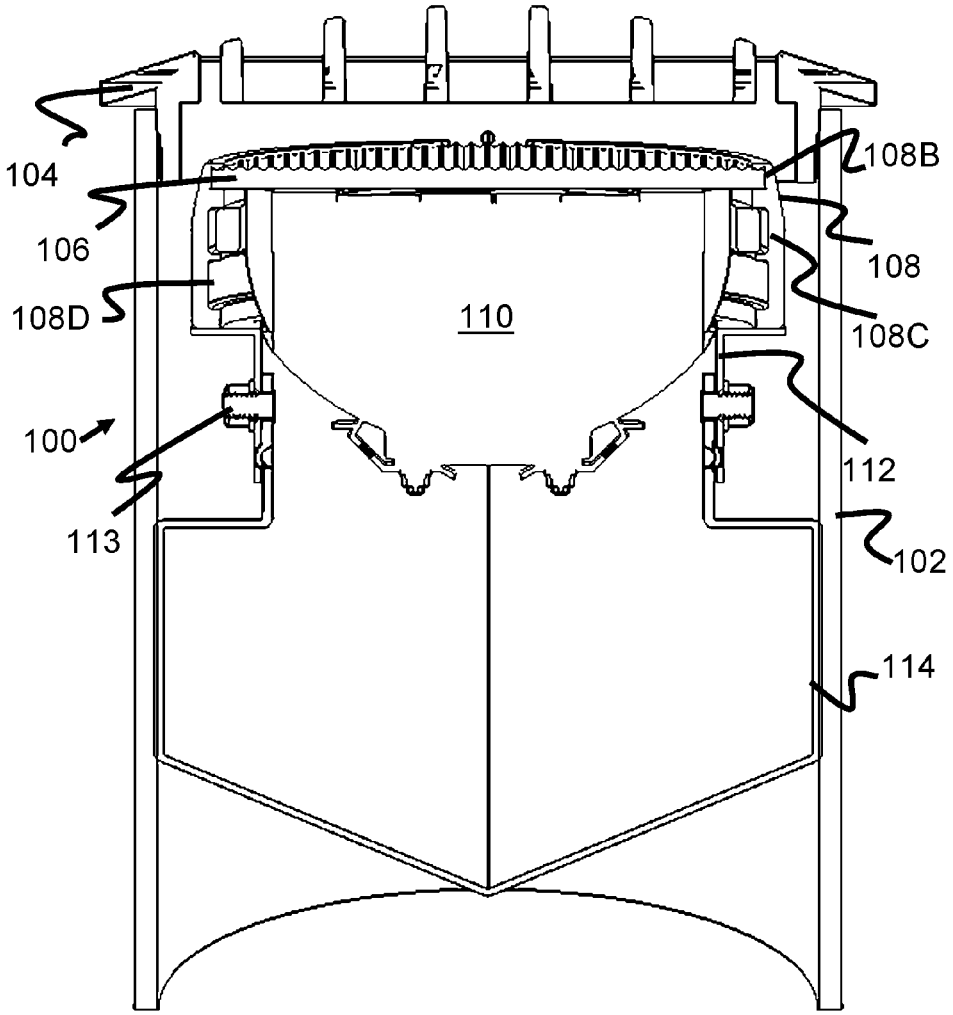
Figure 4:
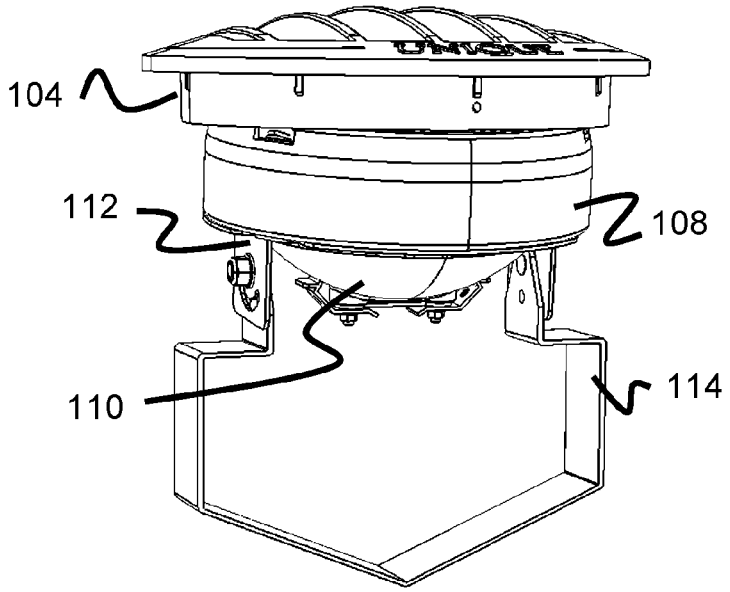
Figure 5:
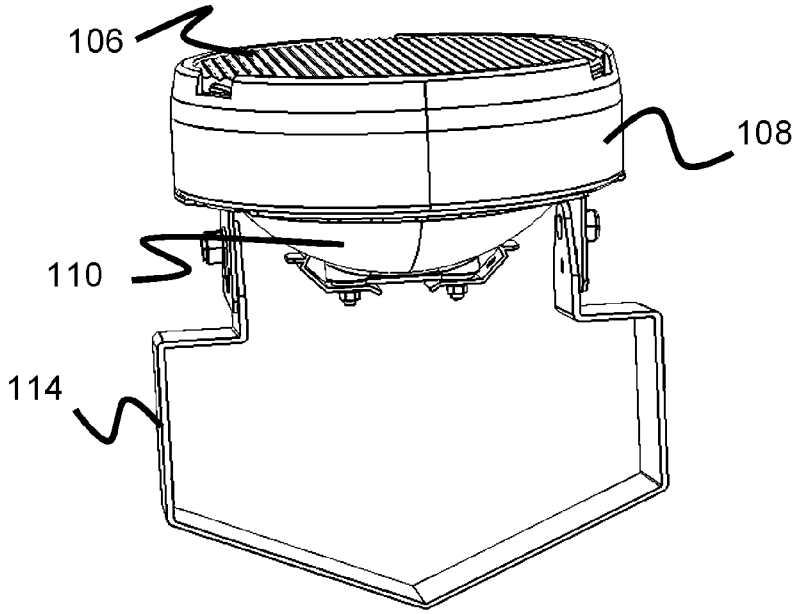
Figure 6:
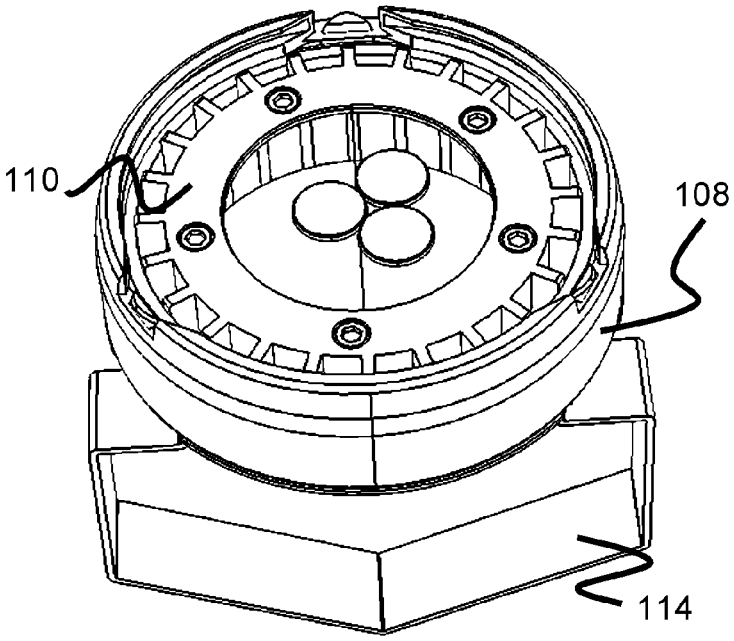

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The present invention is generally directed to light assemblies or lamps that have an elastomeric retention ring for retaining various components in their desired orientation. The elastomeric retention ring can improve retention and centering of its components, as well as reduce the number and cost of the retaining mechanism versus prior designs.

FIGS. 1-10 illustrate various aspects and components of an outdoor lamp assembly 100. The lamp assembly 100 includes an elastomeric ring 108 (e.g., composed of silicone or rubber) that secures several components of the lamp assembly 100 together within the outer cylindrical housing 102 and top grate 104.

Specifically, the elastomeric ring 108 is located within an outer cylindrical housing 102 composed of metal and retains a lens 106, a light bulb 110, and the metal support ring 112. The lens 106 is preferably composed of a clear or tinted material that allows light to pass through and has a generally circular shape. The lens 106 is positioned in a top circular groove 108B that is located circumferentially along the inner surface of the ring 108 and is sized in thickness and diameter to accommodate the lens 106.

Beneath the top groove 108B is a second groove 108C, which is sized in thickness and diameter to accommodate a circumferential flange on the light bulb 110 (e.g., LED or incandescent). A third groove 108D is located beneath the second groove 108C, but does not specifically retain any component.

Figure 7:
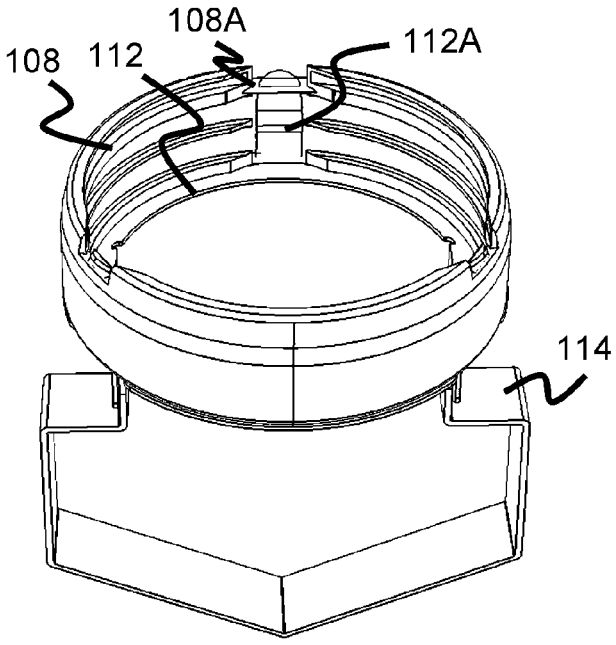
Figure 8:
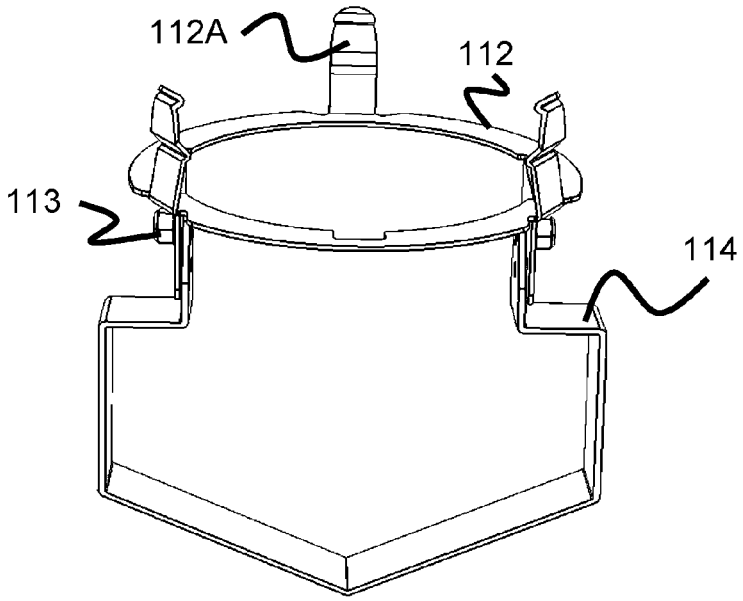
Figure 9:
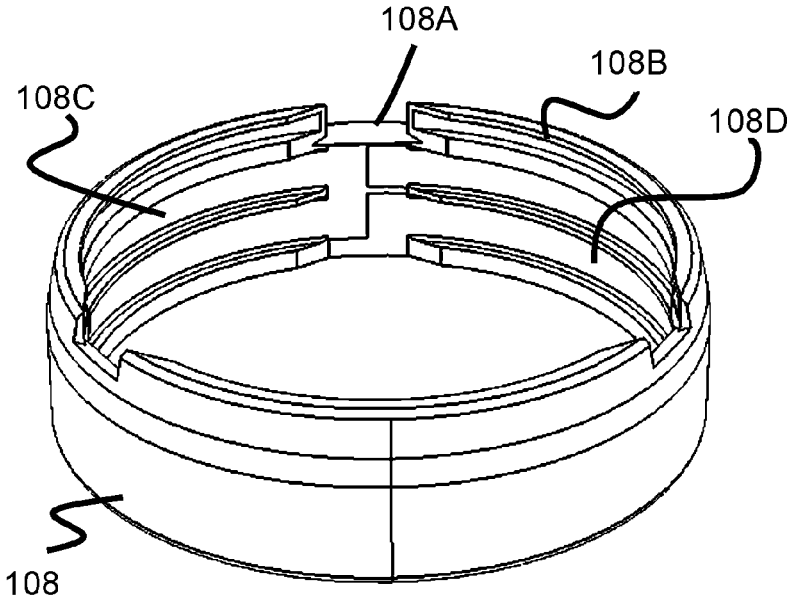
Figure 10:
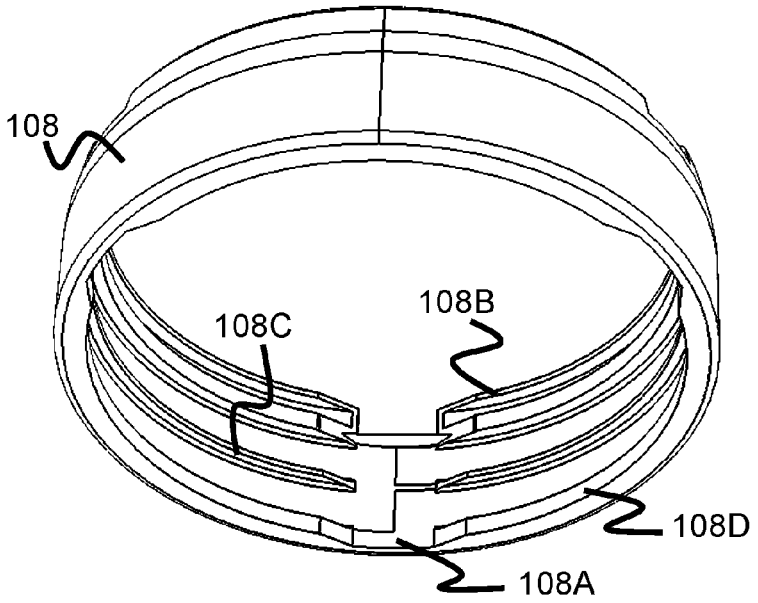
Figure 11:
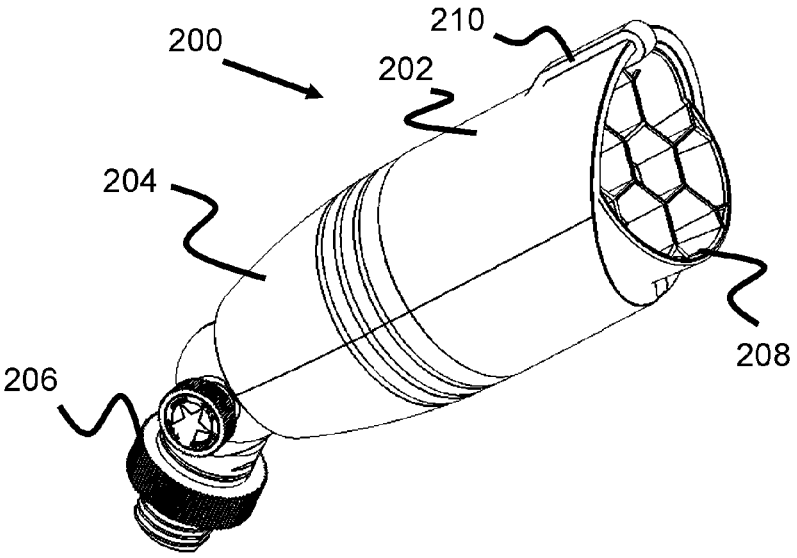
FIGS. 11-19 illustrate various views of another embodiment of a light assembly having an elastomeric ring.
Figure 12:
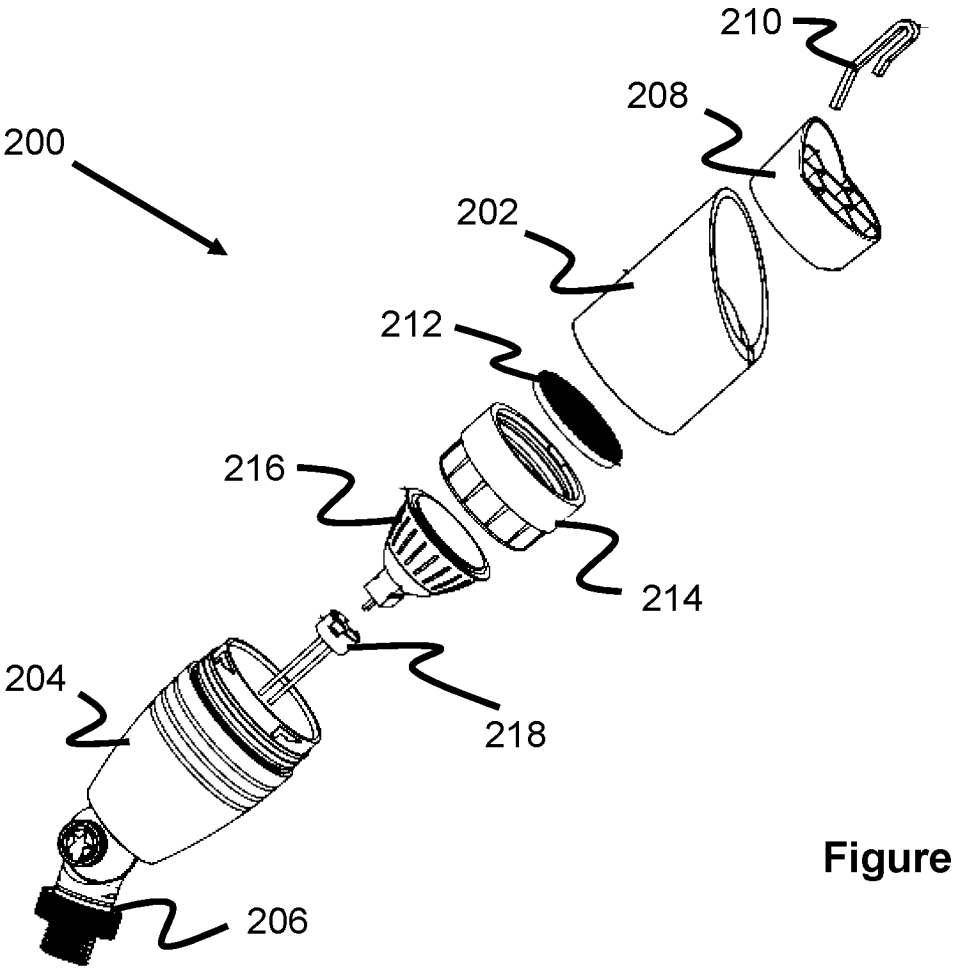

As best seen in FIGS. 7 and 8, the ring 108 is supported by a bottom bracket 114 that is mounted to the inside of the outer metal housing 102 and that pivotally mounts, via screws 113, to the support ring 112. The support ring has a circular, ring shape with three finger elements 112A that extend upward and perpendicularly from the ring portion. As best seen in FIG. 7, the finger elements 112A are each positioned within vertical channels 108A of the elastomeric ring 108 and are further bent so as to engage the light bulb 110. In this respect, the vertical channels 108A "interrupt" the grooves 108B, 108C, and 108D.

In this respect, the elastomeric ring 108 provides a higher degree of flexibility, friction, and resilience with the components of the light assembly 100 then may otherwise occur if only mechanisms such as the finger elements 112A secured the light bulb 110 and lens 106.

FIGS. 11-19 illustrate another embodiment of a lamp assembly 200 that has an elastomeric ring 214 that secures several components within a pivotal base 106, a housing base 204, and a top housing portion 202, allowing the light to pass through grate 208 (secured via clip 210).

The elastomeric ring 214 includes a top groove 214B that is sized in diameter and thickness to accommodate a circular lens 212 within it. The ring 214 further includes two additional grooves 214C and 214D that are not used to support any components in this embodiment.

Figure 13:
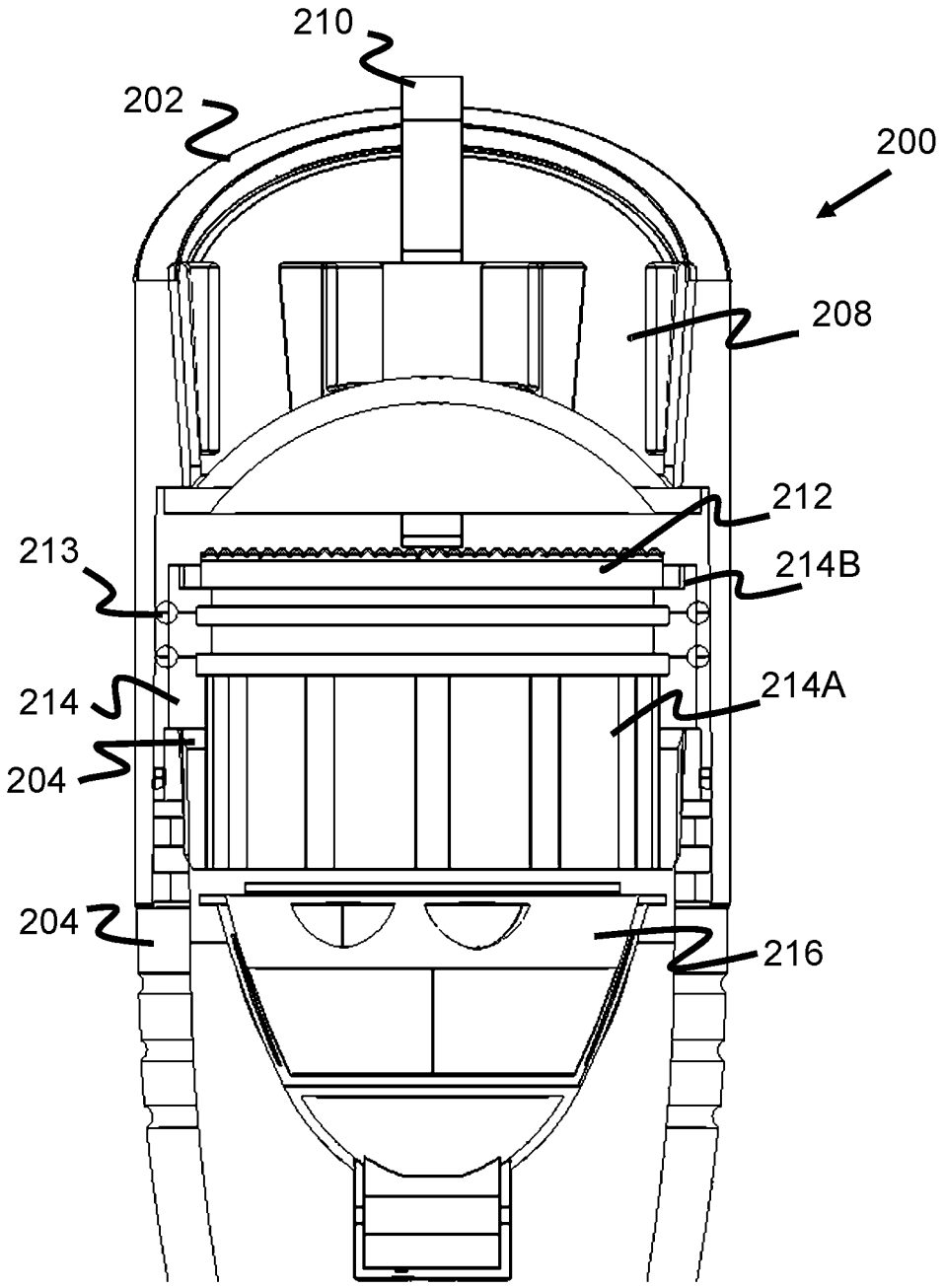
Figure 14:
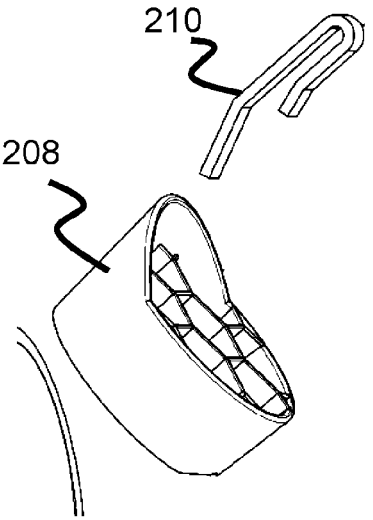
Figure 15:
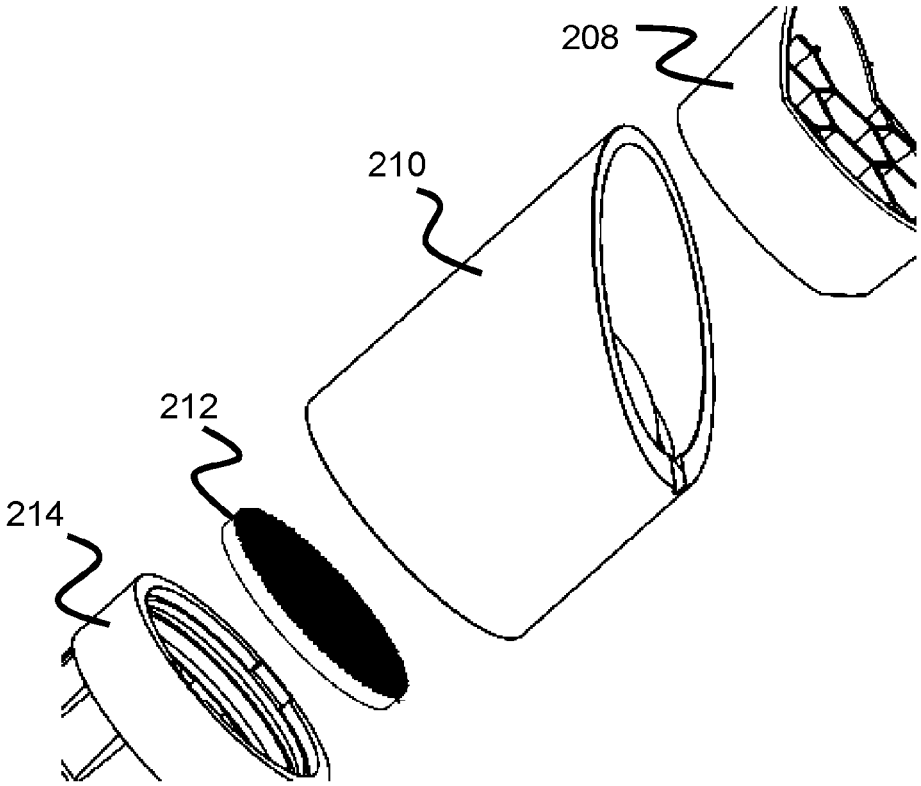
Figure 16:
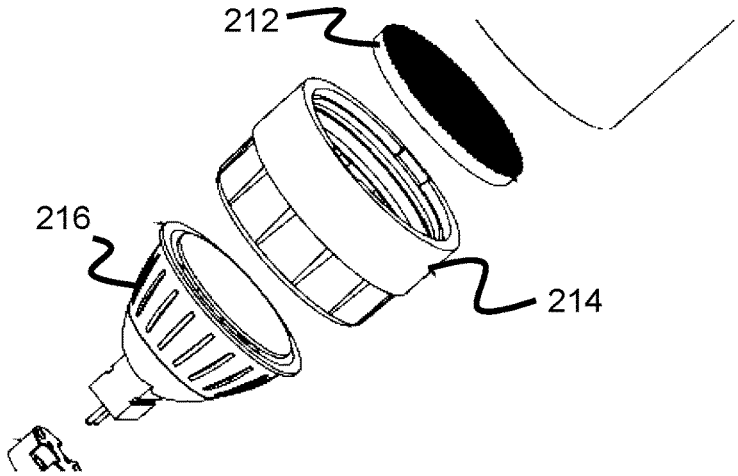
Figure 17:
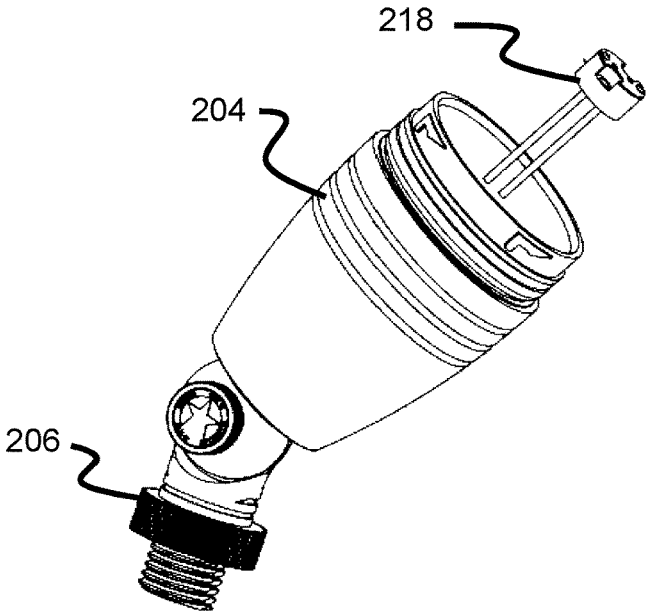
Figure 18:
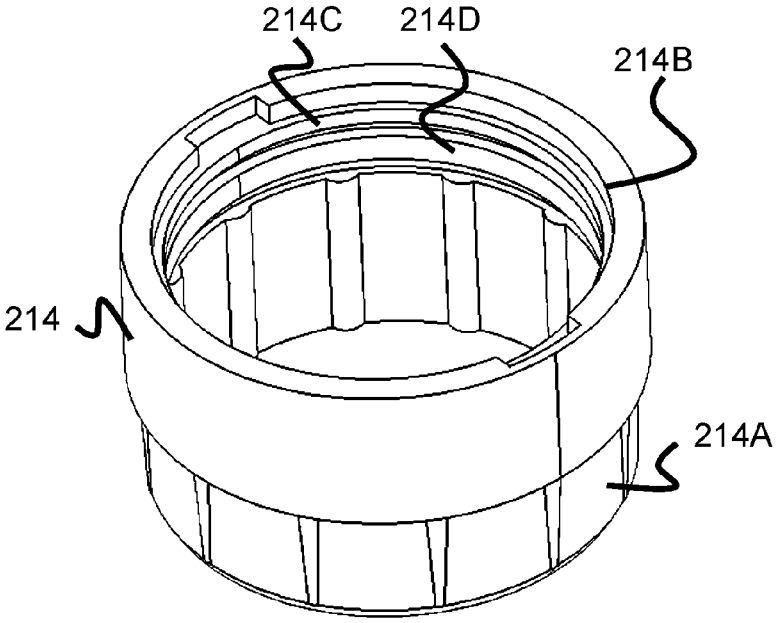
Figure 19:
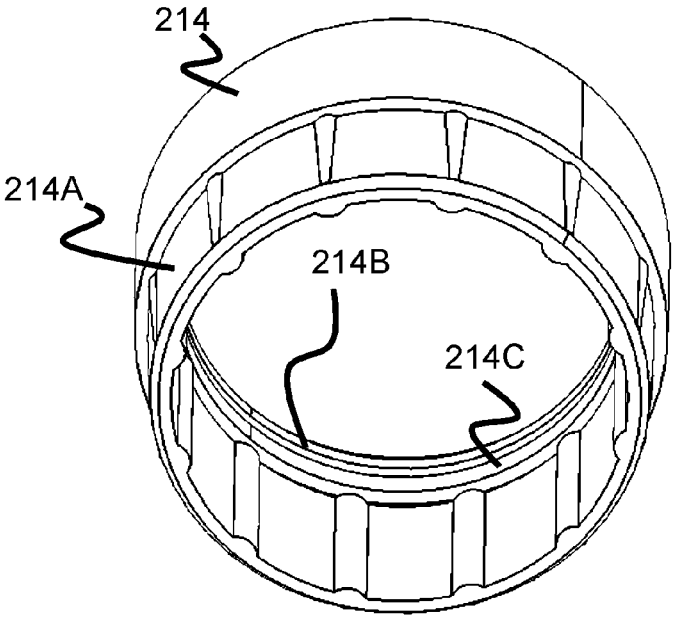
Figure 20:
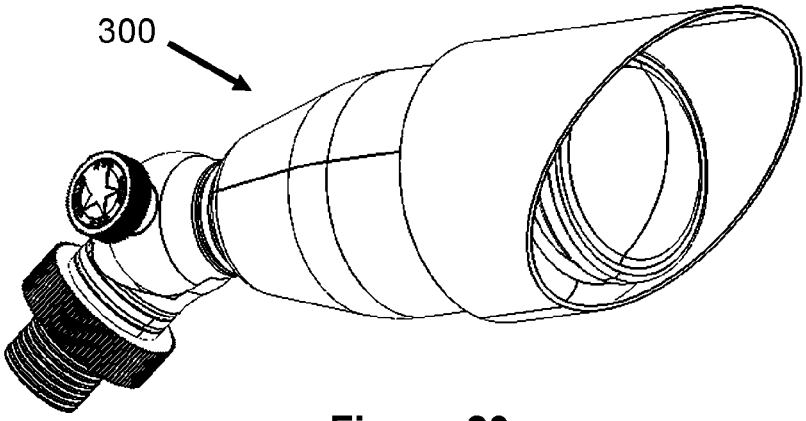
FIGS. 20-25 illustrate various views of another embodiment of a light assembly having an elastomeric ring.
Figure 21:
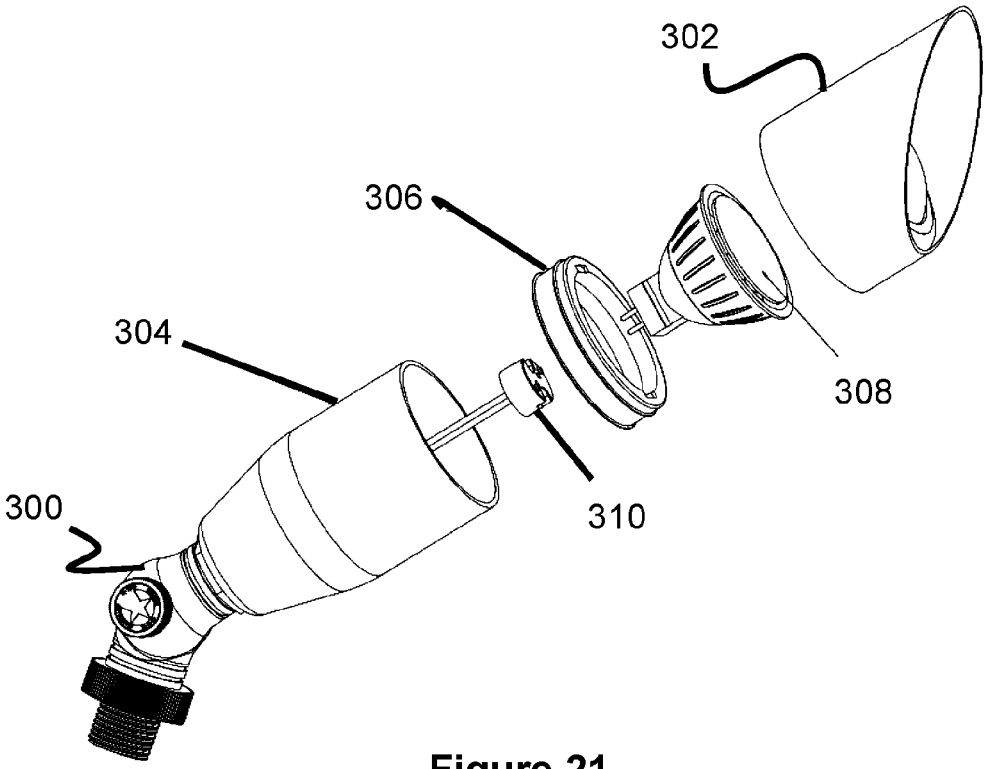
Figure 22:
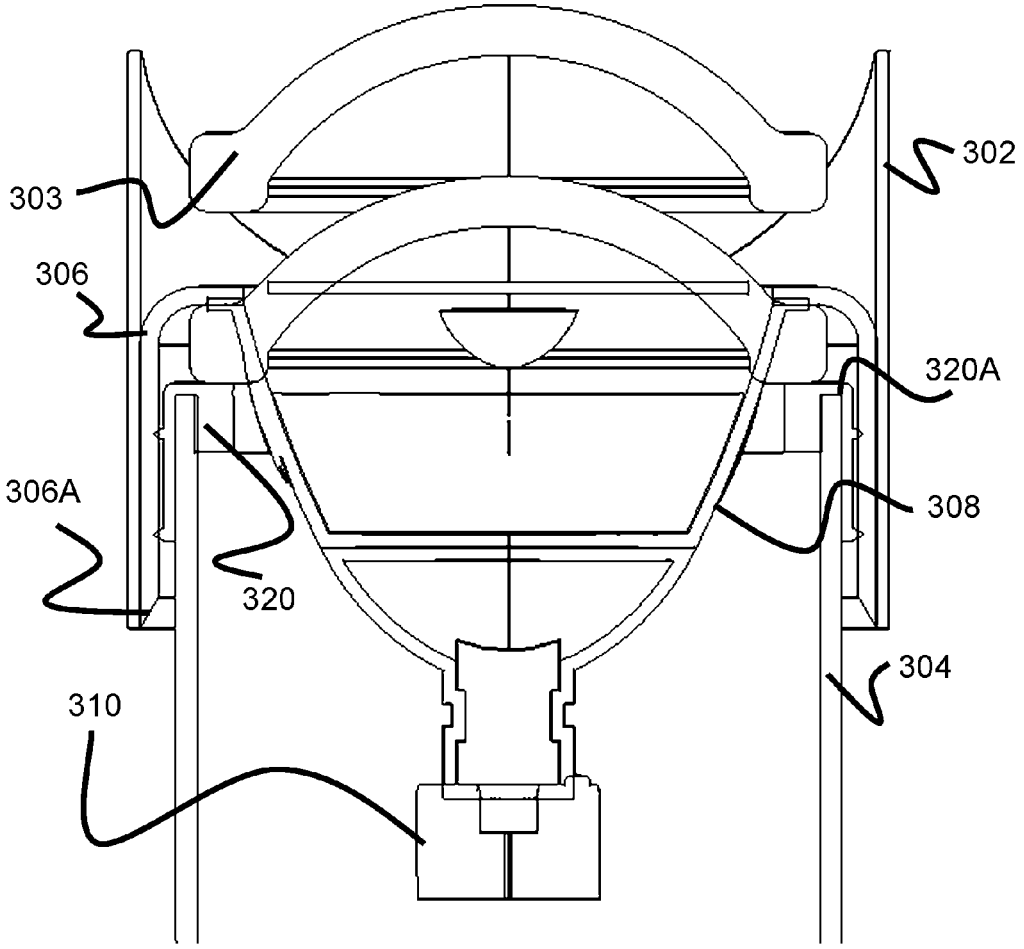
Figure 23:
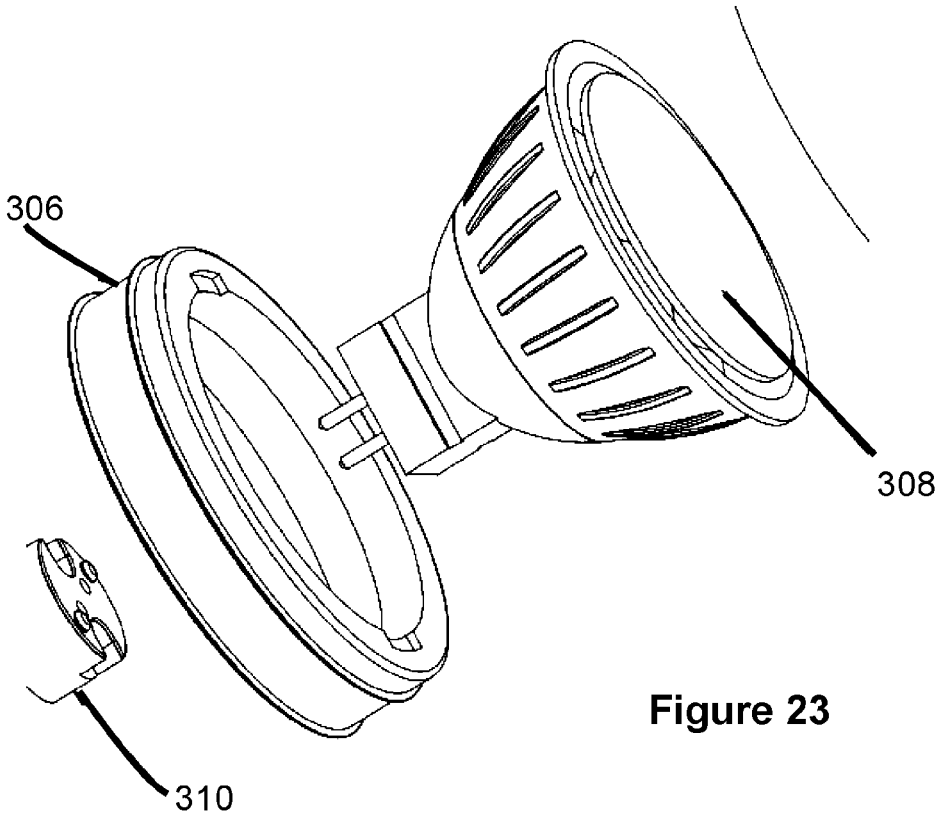
Figure 24:
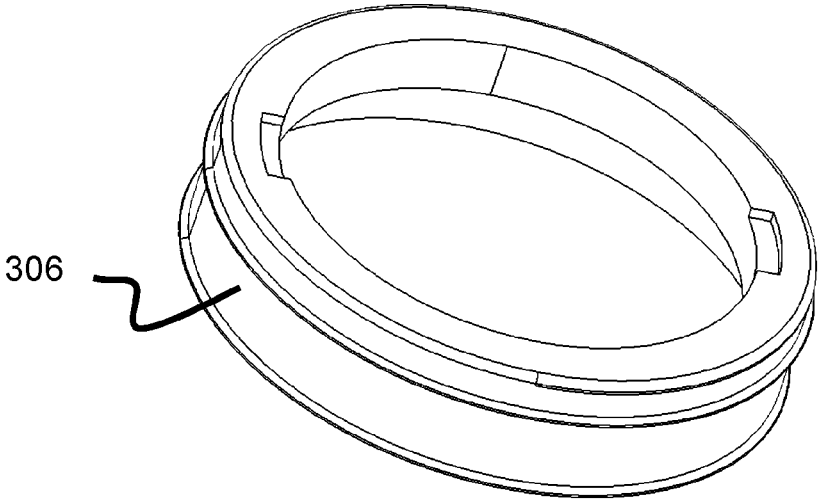
Figure 25:
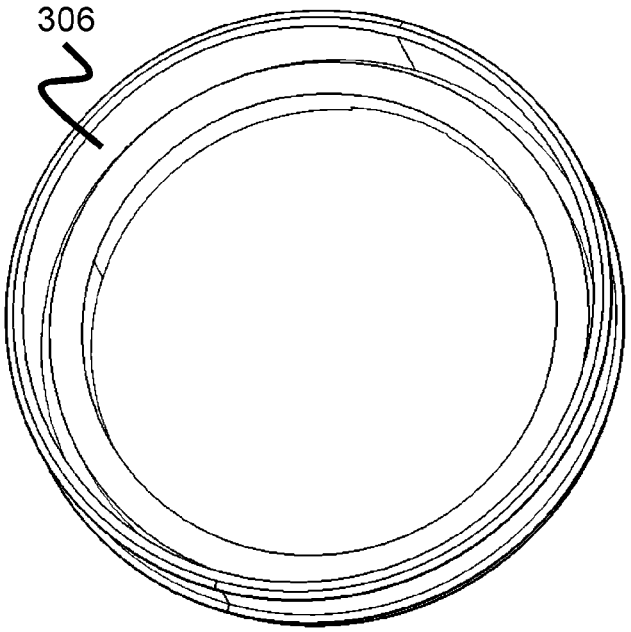
Figure 26:
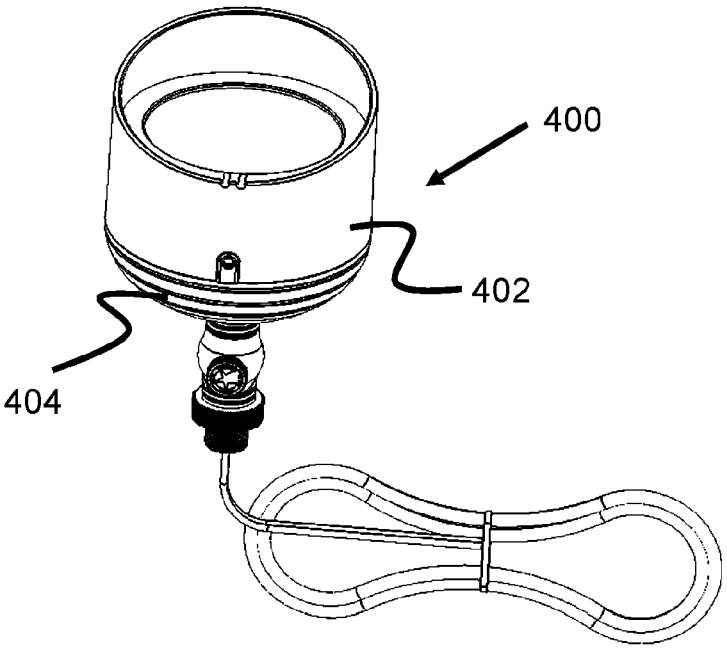
FIGS. 26-31 illustrate various views of another embodiment of a light assembly having an elastomeric ring.
Figure 27:
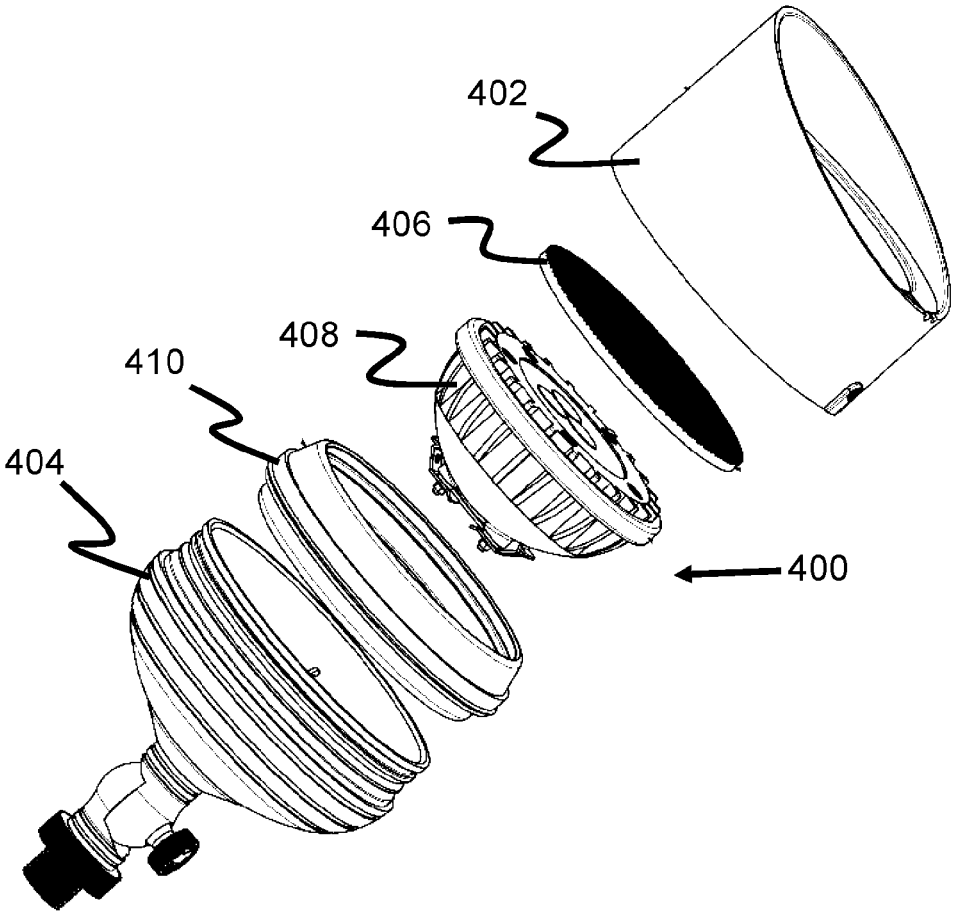
Figure 28:
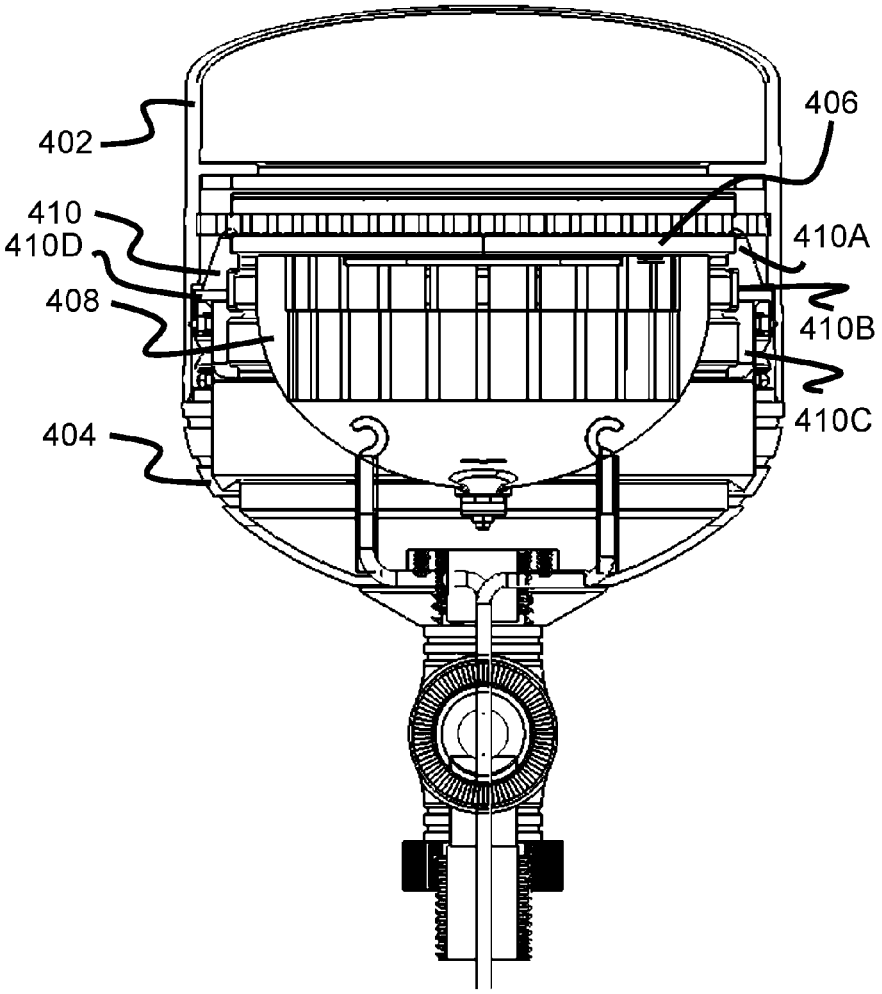
Figure 29:
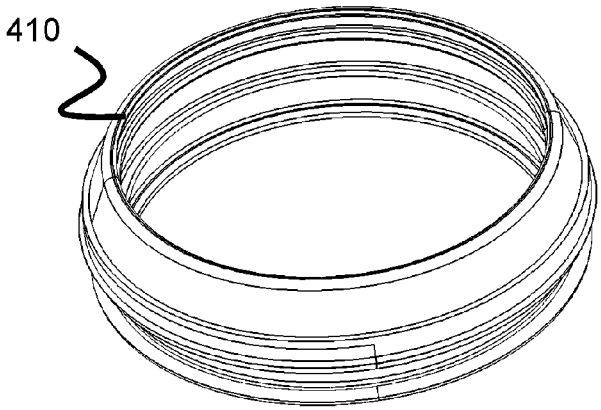
Figure 30:
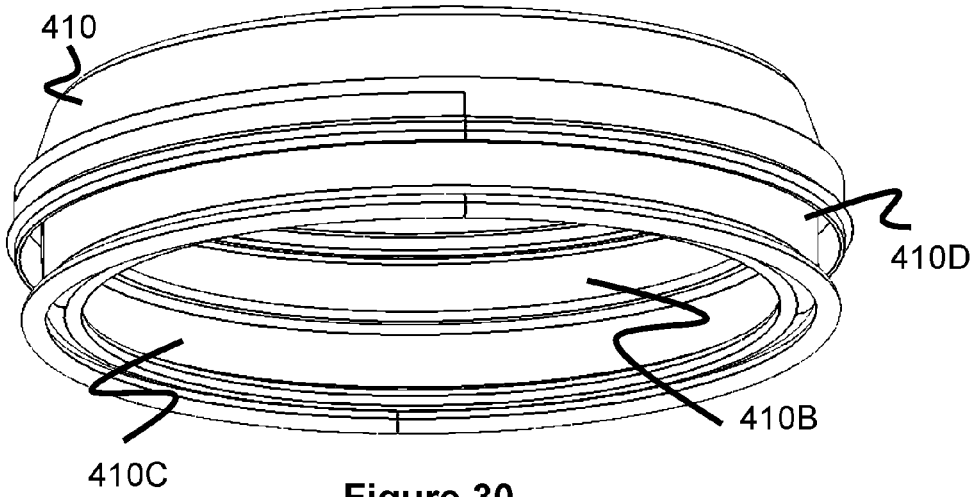
Figure 31:
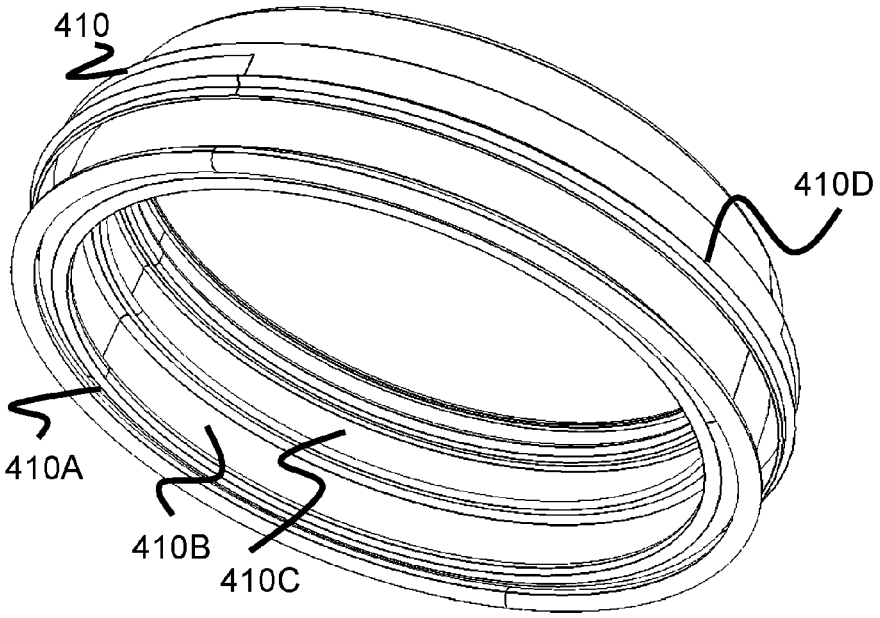

As best seen in FIG. 13, the elastomeric ring 214 rests on a top surface of a flange on the light bulb 216. Additionally, the housing base 204 includes an inner, circular flange that contacts and supports an outer surface of a vertically-ribbed reduced diameter portion 214A of the ring 214. As also seen in FIG. 13, one or more radial seals 213 can be included between the ring 214 and the inside of the top housing portion 202 to help prevent water and dirt from entering the interior of the housing portion 204.

FIGS. 20-25 illustrate aspects of another embodiment of a lamp assembly 300 that has a top elastomeric ring 306 and a bottom elastomeric ring 320 that support components within a cylindrical housing base 304, a housing top 302, and curved lens 303. Specifically, the top elastomeric ring 306 has a generally cylindrical shape that curves inward near its top. This curved top surface is positioned over an outer flange of a light bulb 308. The bottom elastomeric ring 320 has a generally cylindrical shape with a downwardly-facing groove 320A that is positioned over the top of the housing base 304. The bottom of the flange of the light bulb 308 is positioned on the top surface of the bottom elastomeric ring 320.

The sides of the top elastomeric ring 306 overlap on an outside of the outer surface of the bottom elastomeric ring 320. Optionally, the outer side surfaces of the bottom elastomeric ring 320 can include protrusions shaped as rings to help seal and isolate the interior of the cylindrical housing base and its electrical components (e.g., wires and bulb socket 310).

FIGS. 26-31 illustrate another embodiment of a light assembly 400, having an elastomeric ring 410 that supports various components within a top shroud housing 402 and a bottom housing 404.

The elastomeric ring 410 has a generally cylindrical shape with a top groove 410A that is sized in thickness and diameter to support a circular lens 406. A second groove 410B is located below groove 410A on the inner surface of the ring 410 and is sized in thickness and diameter to support an outer flange of a light bulb 408. A third, inner groove 410C is not used to support a component in this embodiment. The ring 410 further includes a protrusion or lip 410D that extends around an outer surface of the ring 410, engaging the inner surface of the top shroud housing 402 and resting on top of a top surface of the bottom housing 404.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A light assembly comprising:

an outer light assembly housing comprising a housing base and a housing top; said housing top being connected to a top of said housing base;

an elastomeric ring disposed within the outer light assembly housing and engaging said outer light assembly housing; said elastomeric ring having a tubular shape with an inner surface forming a passage therethrough; said elastomeric ring having a plurality of lateral grooves located in said passage; said plurality of lateral grooves including a first groove extending around said inner surface; and, a light bulb having an outer flange disposed within said first groove of said elastomeric ring, such that said elastomeric ring maintains a position of said light bulb relative to said outer light assembly housing.

2. The light assembly of claim 1, further comprising a lens engaged within a second groove of said elastomeric ring and above said light bulb.

3. The light assembly of claim 1, further comprising a support ring having a plurality of finger elements that each extend vertically within vertical channels of said elastomeric ring.

4. The light assembly of claim 1, wherein said elastomeric ring has a protrusion extending around an outer surface of said elastomeric ring.

5. The light assembly of claim 1, further comprising a lens positioned within a recess along a top of said elastomeric ring.

6. The light assembly of claim 1, wherein the elastomeric ring is composed of a first ring and a second, separate elastomeric ring, and wherein said first elastomeric ring is disposed around said second, separate elastomeric ring.

7. A light assembly comprising:

an outer light assembly housing comprising a housing base and a housing top; said housing top being connected to a top of said housing base and having an opening configured to allow light to shine therethrough;

an elastomeric ring disposed within the outer light assembly housing; said elastomeric ring having a plurality of lateral grooves located within a passage of said elastomeric ring; and, a light bulb having an outer periphery positioned in one of said plurality of lateral grooves of said elastomeric ring such that said elastomeric ring maintains a position of said light bulb relative to said housing base and said housing top.

8. The light assembly of claim 7, further comprising a lens disposed within one of said plurality of lateral grooves of said elastomeric ring.

9. The light assembly of claim 7, further comprising a support ring having a plurality of finger elements that each extend vertically within vertical channels of said elastomeric ring.

10. The light assembly of claim 7, wherein said elastomeric ring has a protrusion extending around an outer surface of said elastomeric ring.

11. The light assembly of claim 7, further comprising a lens disposed within one of said plurality of lateral grooves of said elastomeric ring and being located above said light bulb.

12. A light assembly comprising:

a housing base having a cavity therein;

a housing top having a tubular shape forming a bottom opening engaging a top of said housing base and a top opening configured to allow light to shine therethrough;

an elastomeric tube disposed within the outer light assembly housing and contacting an interior of said housing base and an interior of said housing top; said elastomeric tube having an inner surface forming a passage therethrough with a plurality of horizontal grooves; said plurality of horizontal grooves having a first groove extending around said inner surface; and, a light bulb having an outer flange disposed within said first groove of said elastomeric tube;

wherein said elastomeric tube maintains a position of said light bulb within and relative to said housing base.

13. The light assembly of claim 12, further comprising a lens engaged within a second groove of said elastomeric ring and above said light bulb.

14. The light assembly of claim 12, further comprising a support ring having a plurality of finger elements that each extend vertically within vertical channels of said elastomeric ring.

15. The light assembly of claim 12, wherein said elastomeric ring has a protrusion extending around an outer surface of said elastomeric ring.

16. The light assembly of claim 12, further comprising a lens positioned within a recess along a top of said elastomeric ring.

17. The light assembly of claim 12, wherein the elastomeric ring is composed of a first ring and a second, separate elastomeric ring.

18. A light assembly comprising:

an outer light assembly housing comprising a housing base and a housing top; said housing top being connected to a top of said housing base;

an elastomeric ring disposed within the outer light assembly housing and engaging said outer light assembly housing; said elastomeric ring having a tubular shape with an inner surface forming a passage therethrough; said elastomeric ring having a first groove extending around said inner surface;

a light bulb having an outer flange disposed within said first groove of said elastomeric ring; and, a lens engaged within a second groove of said elastomeric ring and above said light bulb.

19. A light assembly comprising:

an outer light assembly housing comprising a housing base and a housing top; said housing top being connected to a top of said housing base;

an elastomeric ring disposed within the outer light assembly housing and engaging said outer light assembly housing; said elastomeric ring having a tubular shape with an inner surface forming a passage therethrough; said elastomeric ring having a first groove extending around said inner surface;

a light bulb having an outer flange disposed within said first groove of said elastomeric ring; and, comprising a support ring having a plurality of finger elements that each extend vertically within vertical channels of said elastomeric ring.

* * * * *